US005444200A

United States Patent [19]

Ikari

[11] Patent Number: 5,444,200

[45] Date of Patent: Aug. 22, 1995

[54] ICE DETECTION DEVICE

[75] Inventor: Hideyuki Ikari, Kariya, Japan

[73] Assignee: Hoshizaki Denki Kabushiki Kaisha, Toyoake, Japan

[21] Appl. No.: 119,580

[22] Filed: Sep. 13, 1993

[30] Foreign Application Priority Data

Sep. 14, 1992 [JP] Japan ..... 4-064114 U

[51] Int. Cl.[6] ..... H01H 35/00

[52] U.S. Cl. ..... 200/61.2; 222/64

[58] Field of Search ..... 62/66, 137, 344; 200/61.2, 52 R, 61.45 M; 222/56, 64, 146.6, 452, 639, 643; 340/612

[56] References Cited

U.S. PATENT DOCUMENTS 3,441,176 4/1969 Reynolds et al. ..... 222/70
4,787,539 11/1988 Uchida et al. ..... 222/639
5,213,204 5/1993 Sommer ..... 200/303

FOREIGN PATENT DOCUMENTS 56-60188 5/1981 Japan .
59-178572 12/1984 Japan .

*Primary Examiner*—Marc S. Hoff
*Assistant Examiner*—Michael A. Friedhofer
*Attorney, Agent, or Firm*—Nikaido, Marmelstein, Murray & Oram

[57] ABSTRACT

An ice detection device for detecting ice pieces supplied into and stored in an ice storage bin, which includes a removable lid formed with a cylindrical guide portion and coupled over an upper opening end of the storage bin, a hollow piston mounted for vertical movement within the guide portion of the lid, a float plate fixed to a lower end of the hollow piston to cover the ice pieces stored in the storage bin, a removable cap coupled over the lid, the cap being formed to close an upper opening of the guide portion of the lid and formed at its center with a cylindrical projection extending therefrom into an axial bore of the hollow piston, a permanent magnet mounted on an upper portion of the hollow piston, and a magnetically operated switch mounted within the cylindrical projection of the cap to cooperate with the permanent magnet.

6 Claims, 4 Drawing Sheets

ICE DETECTION DEVICE

BACKGROUND OF THE INVENTION

1. Field of the Invention

The present invention relates to an ice detection device adapted for use in an ice storage bin to detect ice pieces supplied into and stored in the ice storage bin from an ice making mechanism, and more particularly to an electromagnetic ice detection device arranged to deactivate the ice making mechanism when detected the ice pieces fully stored in the ice storage bin.

2. Description of the Prior Art

In Japanese Utility Model Laid-open Publication 56-60188, there has been proposed an electric ice detection device of the type as shown in FIG. 4, which includes a tubular guide rod 12 fixed at its upper end to a removable lid 11*a* of an ice storage bin 11 and extended into the interior of the storage bin 11, a float plate 13 mounted for vertical movement on the guide rod 12, and an electromagnetic switch 14 disposed within an upper portion of the guide rod 12 to cooperate with a permanent magnet 15 mounted on the float plate 13 for detecting ice pieces supplied into and stored in the ice storage bin 11. When the ice storage bin 11 is filled with ice pieces supplied from an ice making mechanism 10, the float plate 13 is raised by the supplied ice pieces to an uppermost position so that the electromagnetic switch 14 is operated by the magnetic flux of permanent magnet 15. In Japanese Utility Model Laid-open Publication 59-178572, there has been proposed an electric ice detection device of the type as shown in FIG. 5, which includes a movable support rod 16 assembled with a lid 11*a* of an ice storage bin 11, a float plate 17 fixed to the lower end of support rod 16 to be raised by ice pieces supplied into and stored in the storage bin 11, a stopper 18 fixed to the upper end of support rod 16, and a microswitch 19 of the normally closed type mounted on the lid 11*a* of storage bin 11 and provided with an operation lever 19*a* in engagement with the stopper 18. When the ice storage bin 11 is filled with ice pieces supplied from an ice making mechanism 10, the float plate 17 is raised by the supplied ice pieces to move the stopper 16 upward to an uppermost position so that the operation lever 16 is released to turn off the microswitch 19.

In the former ice detection device shown in FIG. 4, the tubular guide rod 12 is brought into contact with the supplied ice pieces in accordance with upward movement of the float plate 13. This causes fine ice pieces to adhere to the outer circumference of guide rod 12 and to obstruct the upward movement of float plate 13. In the latter ice detection device shown in FIG. 5, the operation lever 19 is mechanically displaced by the stopper 18 to control on-off operation of the microswitch 19. It is, therefore, apparent that the support member of operation lever 19*a* will be deformed by use of the ice detection device for a long period of time to cause malfunction of the detection device.

SUMMARY OF THE INVENTION

It is, therefore, a primary object of the present invention to provide an improved ice detection device capable of securely detecting ice pieces fully stored in an ice storage bin in use of the detection device for a long period of time without causing any problems discussed above.

According to the present invention, the object is accomplished by providing an ice detection device for detecting ice pieces supplied into and stored in an ice storage bin, which comprises a removable lid formed with a cylindrical guide portion and coupled over an upper opening end of the storage bin, a hollow piston mounted for vertical movement within the guide portion of the lid, a float plate fixed to a lower end of the hollow piston to cover the ice pieces stored in the storage bin, a removable cap coupled over the lid, the cap being formed to close an upper opening of the guide portion of the lid and formed at its center with a cylindrical projection extending therefrom into an axial bore of the hollow piston, a permanent magnet mounted on an upper portion of the hollow piston, and a magnetically operated switch mounted within the cylindrical projection of the cap to cooperate with the permanent magnet.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
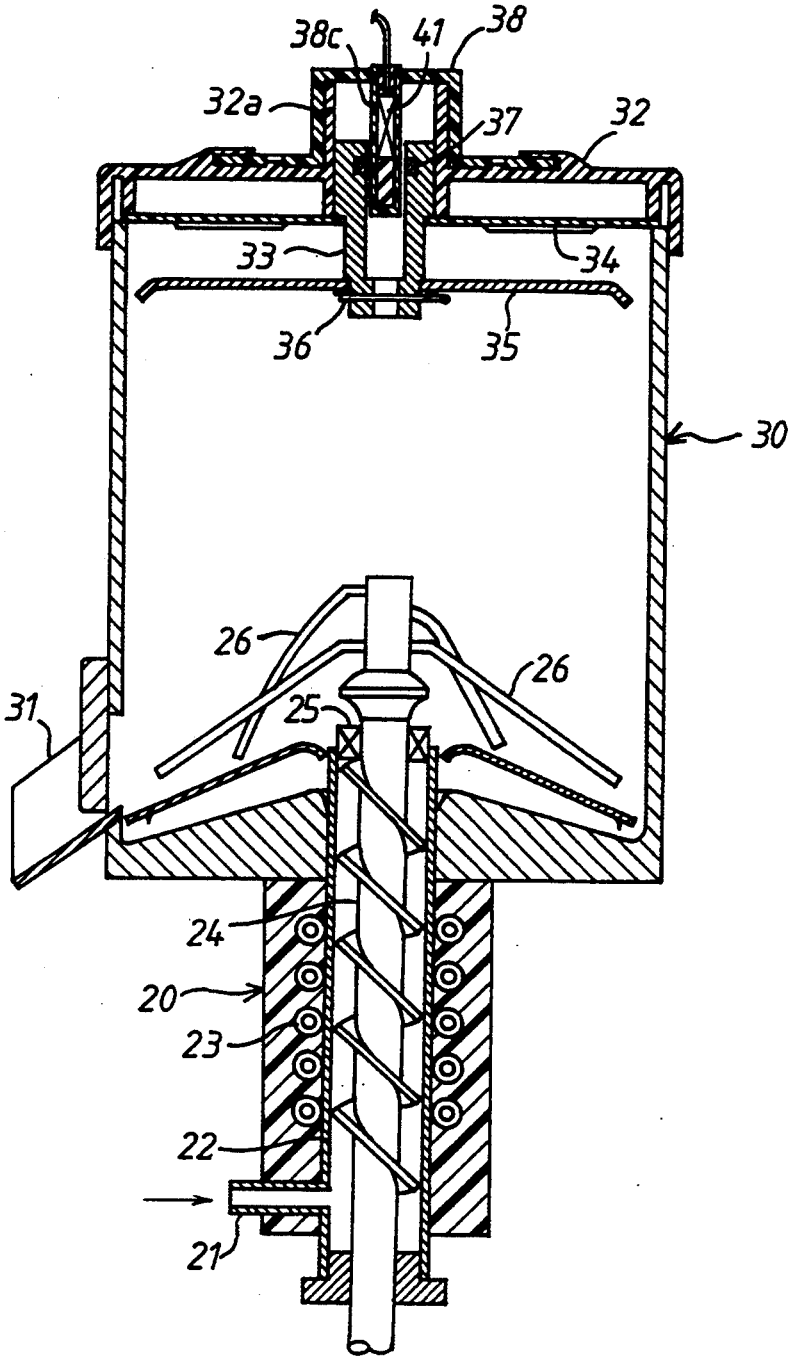
FIG. 1 is a vertical sectional view of an ice storage bin provided with an ice detection device according to the present invention.

Referring now to the drawings, FIG. 1 illustrates an ice storage bin 30 which is mounted on an ice making mechanism 20 of the auger type and provided with an ice detection device according to the present invention. The ice making mechanism 20 includes a cylindrical evaporator housing 22 vertically mounted on a casing of a drive mechanism (not shown) and provided at its lower end portion with an inlet pipe 21 to be supplied with fresh water from a source of water (not shown), an evaporator coil 23 wound around the evaporator housing 22 and covered with insulation material, and an auger 24 mounted for rotary movement within the evaporator housing 22 and in drive connection with the drive mechanism. The evaporator housing 22 is provided at its upper end with an extrusion head 25 which is formed with a plurality of circumferentially equally spaced vertical passages for compressing and extruding ice supplied thereto by rotation of the auger 24. The auger 24 is provided at its upper end with a plurality of agitating rods 26 for agitating ice pieces supplied into the ice storage bin 30 from the ice making mechanism 20.

Figure 2:
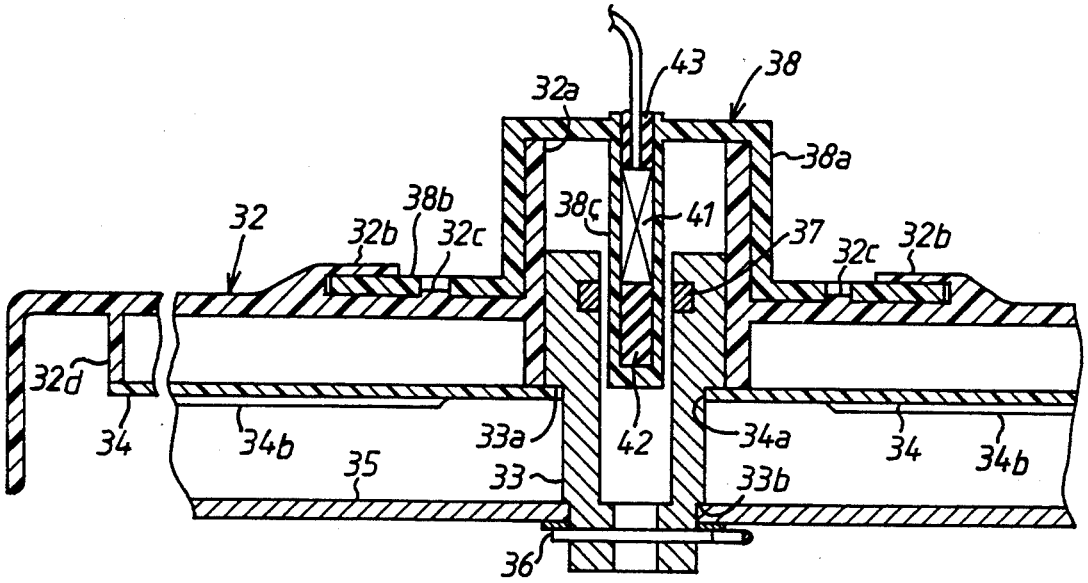
FIG. 2 is an enlarged sectional view of the ice detection device shown in FIG. 1.

The ice storage bin 30 is in the form of a cylindrical container provided at its bottom portion with an ice delivery chute 31. An upper opening end of the storage bin 30 is closed by a removable circular lid 32 of synthetic resin coupled thereon. As shown in FIGS. 1 and 2, the circular lid 32 is integrally formed at its center with a cylindrical guide portion 32*a* which extends upwardly and downwardly from lid 32. The circular lid 32 is further integrally formed thereon with a pair of diametrically spaced lugs 32*b*, 32*b* which are positioned symmetrically with respect to the center of guide portion 32*a*. The circular lid 32 is further integrally formed thereon with a pair of diametrically spaced projections 32*c*, 32*c* which are positioned between the guide portion 32*a* and the respective lugs 32*b*.

A stepped hollow piston 33 is slidably mounted for vertical movement within the guide portion 32*a* of lid 32. The hollow piston 33 has an upper stepped portion 33*a* which is engaged with a central hole 34*a* of an internal lid 34 to restrict downward movement of the hollow piston 33. The internal lid 34 is secured at its central portion to the lower end of guide portion 32*a* and at its peripheral portion to an annular rib 32*d* of lid 32. The internal lid 34 is formed at its bottom surface with a pair of diametrically spaced radial ribs 34*b*, 34*b* which are arranged to receive a float plate 35 for facilitating separation of the float plate from the internal lid 34. The float plate 35 is coupled at its central portion with a lower stepped portion 33*b* of hollow piston 33 and fixed in place by means of a split pin 36 radially inserted into the piston 33. The float plate 35 is in the form of a disk plate formed to cover ice pieces supplied into the storage bin 30 from the ice making mechanism 20. In such an arrangement of the hollow piston 33, an annular permanent magnet 37 is embedded within an upper portion of hollow piston 33.

Figure 3:
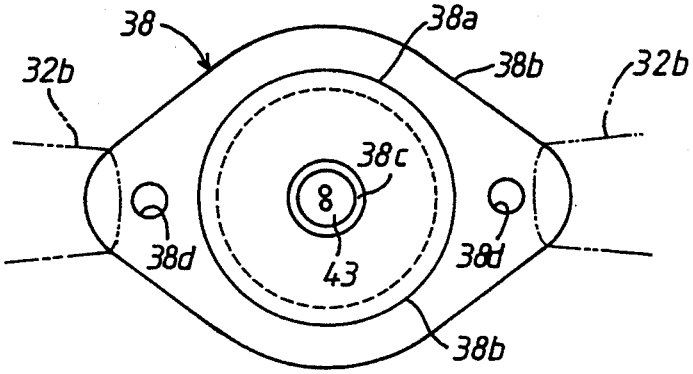
FIG. 3 is a plan view of a removable cap shown in FIG. 2.
Figure 4:
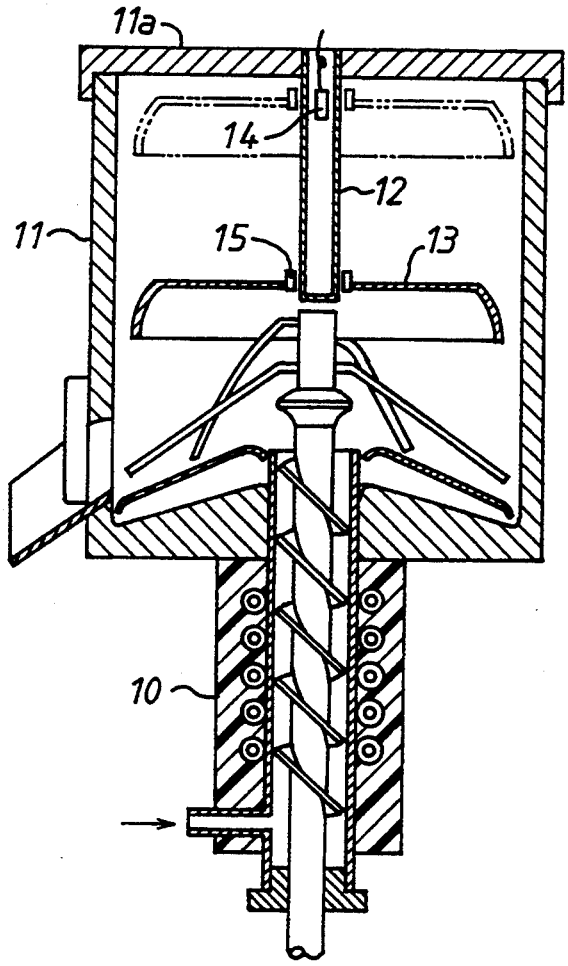
Fig. 4 (PRIOR ART)
FIG. 4 is a vertical sectional view of an ice storage bin provided with a conventional ice detection device.
Figure 5:
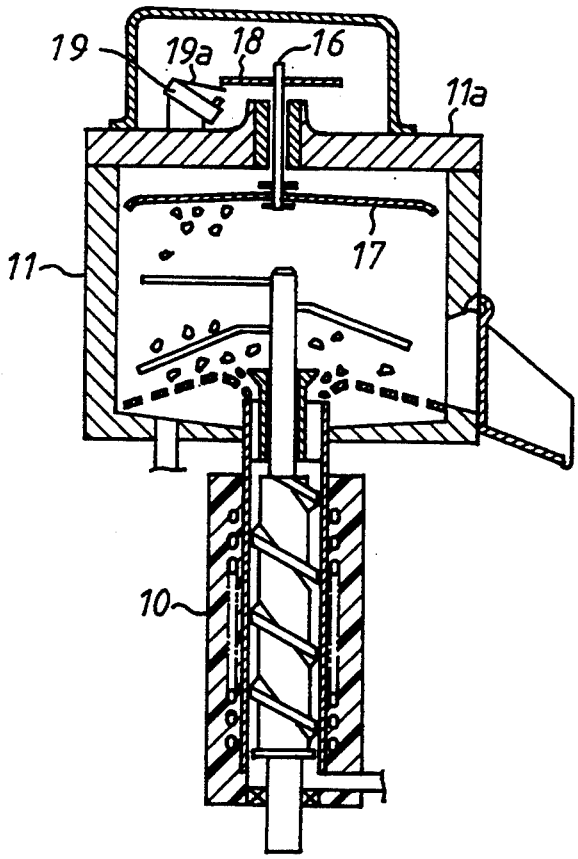
Fig. 5 (PRIOR ART)
FIG. 5 is a vertical sectional view of an ice storage bin provided with another conventional ice detection device.

As shown in FIGS. 2 and 3, a removable cap 38 is coupled over the lid 32 of storage bin 30 to close an upper opening of guide portion 32*a*. The cap 38 has a cylindrical portion 38*a* closed at its upper end and a flange portion 38*b* integrally formed with the lower end of cylindrical portion 38*a*. The closed end of cylindrical portion 38*a* is integrally formed at its center with a cylindrical projection 38*c* which extends downwardly into an axial bore of hollow piston 33 and contains a normally closed reed switch 41 cooperable with the permanent magnet 37 for providing an electromagnetic detection switch. The reed switch 41 is positioned at its lower end by means of an insert element 42 disposed within the lower end of cylindrical projection 38*c* and is positioned at its upper end by means of a seal member 43 disposed within the upper end of cylindrical projection 38*c* for preventing entry of water. The flange portion 38*b* of cap 38 is chamferred at its outer periphery and has a pair of diametrically opposed ends which are engaged with the lugs 32*b*, 32*b* of lid 32 to fasten the cap 38 on the lid 32. The flange portion 38*b* of cap 38 is formed with a pair of diametrically spaced holes 38*d*, 38*d* which are engaged with the diametrically spaced projections 32*c*, 32*c* of lid 32 to position the cap 38 on the lid 32 in a circumferential direction.

When the ice detection device is assembled with the ice storage bin 30, the hollow piston 33 is assembled with the guide portion 32*a* of lid 32, and the float plate 35 is fixed to the lower end of hollow piston 33 by means of the split pin 36. Thereafter, the lid 32 is coupled over the opening end of storage bin 30 to insert the float plate 35 into the interior of storage bin 30, and the cap 38 is coupled over the guide portion 32*a* of lid 32 in such a manner that the cylindrical projection 38*c* of cap 38 is inserted into the axial bore of hollow piston 33 and that the diametrically opposed ends of cap 38 are displaced from the lugs 32*b*, 32*b* of lid 32 in a circumferential direction. In such a condition, the flange portion 38*b* of cap 38 is rotated on the lid 32 so that it is engaged with the diametrically spaced projections 32*c*, 32*c* of lid 32 at its diametrically spaced holes 38*d*, 38*d* and engaged with the lugs 32*b*, 32*b* of lid 32 at its diametrically opposed ends to fasten the cap 38 on the lid 32.

During operation of the ice making mechanism 20, the ice storage bin 30 is supplied with ice pieces from the extrusion head 25 of ice making mechanism 20 and stores the ice pieces therein. When the stored amount of ice pieces increases, the float plate 35 is raised by the ice pieces to move the hollow piston 33 upward along the guide portion 32*a* of lid 32. When the storage bin 30 is filled with the ice pieces, the permanent magnet 37 on hollow piston 33 approaches the reed switch 41 and causes the same to turn off for detecting the fully stored condition of the ice pieces in the storage bin 30. In response to turn-off operation of the reed switch 41, the ice making mechanism 20 is deactivated under control of an electric control apparatus (not shown) to stop the supply of ice pieces into the storage bin 30.

As in understood from the above description, the hollow piston 33 does not contact with the stored ice pieces in its vertical movement since the float plate 35 is fixed to the lower end of piston 33. Accordingly, any ice pieces do not adhere to the sliding portion between the hollow piston 33 and the guide portion 32*a* of lid 32. Thus, the vertical movement of hollow piston 33 relative to the guide portion 32*a* of lid 32 is smoothly conducted to ensure the detection of ice pieces fully stored in the storage bin 30. In addition, the permanent magnet 37 is mounted on the hollow piston 33 to operate the reed switch 41 without any mechanical contact therewith. Accordingly, the reed switch 41 can be operated without any troubles for a long period of time to securely detect the ice pieces stored in the storage bin 30.

What is claimed is:

1. An ice detection device for detecting ice pieces supplied into and stored in an ice storage bin, comprising:

a removable lid formed with a cylindrical guide portion and coupled over an upper opening end of said storage bin;

a hollow piston mounted for vertical movement within the guide portion of said lid;

a float plate fixed to a lower end of said hollow piston to cover the ice pieces stored in said storage bin;

a removable cap coupled over said lid, said cap being formed to close an upper opening of the guide portion of said lid and formed at its center with a cylindrical projection extending therefrom into an axial bore of said hollow piston;

a permanent magnet mounted on an upper portion of said hollow piston; and a magnetically operated switch mounted within the cylindrical projection of said cap to cooperate with said permanent magnet.

2. An ice detection device as claimed in claim 1, wherein an internal lid is secured at its central portion to a lower end of said guide portion and at its peripheral portion to an annular rib of said removable lid to restrict downward movement of said hollow piston.

3. An ice detection device as claimed in claim 2, wherein said internal lid is formed at its bottom surface with a plurality of diametrically spaced radial ribs for receiving said float plate when it has been raised by the ice pieces stored in said storage bin.

4. An ice detection device as claimed in claim 1, wherein said removable lid is integrally formed thereon with a pair of diametrically spaced lugs, and wherein said cap has a cylindrical portion coupled over the guide portion of said lid and a flange portion integrally formed with a lower end of said cylindrical portion to be engaged with the diametrically spaced lugs of said lid.

5. An ice detection device as recited in claim 1, wherein said hollow piston includes a stepped portion on an outer circumference thereof.

6. An ice detection device as claimed in claim 2, wherein said hollow piston includes a stepped portion on an outer circumference thereof, and wherein said stepped portion is configured to engage a portion of said internal lid when said hollow piston is at a downwardmost point of movement.

* * * * *